US007412952B2

(12) United States Patent
Jeffries et al.

(10) Patent No.: US 7,412,952 B2
(45) Date of Patent: Aug. 19, 2008

(54) POPPET VALVE OPERATING SYSTEM FOR INTERNAL COMBUSTION ENGINE

(75) Inventors: Jon Jeffries, Canton, MI (US); Todd Brewer, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/608,330

(22) Filed: Dec. 8, 2006

(65) Prior Publication Data

US 2008/0135000 A1 Jun. 12, 2008

(51) Int. Cl.
*F01L 1/18* (2006.01)

(52) U.S. Cl. ..... 123/90.39; 123/90.16; 123/90.27

(58) Field of Classification Search ..... 123/90.39, 123/90.16, 90.27
See application file for complete search history.

(56) References Cited

U.S. PATENT DOCUMENTS 3,034,809 A 5/1962 Greenberg
3,841,280 A 10/1974 Lussier
4,553,515 A 11/1985 King et al.
4,896,635 A 1/1990 Willermet et al.
5,655,741 A 8/1997 Watkins
5,975,251 A * 11/1999 McCarthy ..... 188/31
6,230,676 B1 5/2001 Pryba et al.
6,412,460 B1 * 7/2002 Sato et al. ..... 123/90.16

FOREIGN PATENT DOCUMENTS

DE 10310476 A1 10/2004

* cited by examiner

*Primary Examiner*—Zelalem Eshete
(74) *Attorney, Agent, or Firm*—Dickinson Wright PLLC; Diana Brehob

(57) ABSTRACT

A poppet valve operating system for an internal combustion engine includes poppet valves which are driven by rocker arms rotationally mounted to a rocker shaft. Each of the rocker arms is maintained in axial alignment upon the rocker shaft by a separate, resiliently biased telescoping pin housed in the rocker arm body. The rocker arm pins extend into indexing reliefs formed in the outer cylindrical surface of the rocker shaft.

7 Claims, 3 Drawing Sheets

POPPET VALVE OPERATING SYSTEM FOR INTERNAL COMBUSTION ENGINE

BACKGROUND OF THE INVENTION

1. Field of the Invention

The present invention relates to a poppet valve operating system having a rocker shaft with slidably mountable rocker arms which are indexed upon the rocker shaft by means of reliefs formed in the outer cylindrical surface of the rocker shaft.

2. Disclosure Information

Many overhead valve engines utilize rocker arms for actuating cylinder poppet valves. Such rocker arms are generally either pedestal mounted or shaft mounted. Shaft mounted arms are usually slidably installed upon a cylindrical rocker shaft. Once the arms have been installed, they must be maintained in a precise axial location along the shaft to assure that proper contact is made with the valve and other actuating mechanisms such as a camshaft or push rod. Designers have devised a number of schemes for maintaining rocker arms in a desired position on a rocker shaft. These schemes usually include the use of custom spacers which are interposed between the rocker arms and the mounting pedestals. The spacers are sometimes supplemented by compression springs or other devices. Needless to say, all the devices add weight, complexity and expense. Also, the need for different spacers may lead to misbuilds of the engine cylinder heads.

It would be desirable to provide a rocker arm retention system for use with rocker shaft mounted arms which positively retains rocker arms, but nevertheless permits their disassembly for servicing.

SUMMARY OF THE INVENTION

A poppet valve operating system for an internal combustion engine includes a number of poppet valves which are urged into a closed position by compression springs. At least one rocker shaft is adapted for mounting to a cylinder head of an engine. The rocker shaft has a cylindrical outer surface. A number of indexing reliefs are formed in the outer cylindrical surface of the rocker shaft. Rocker arms for actuating poppet valves are mounted to the rocker shaft. Each rocker arm includes a rocker arm body having a circular bore corresponding to the outer cylindrical surface of the rocker shaft and a resiliently biased telescoping pin housed in the rocker arm body. The telescoping pin has an inner end projecting into the circular bore of the rocker arm body. The telescoping pin extends into one of the indexing reliefs formed in the rocker shaft.

According to another aspect of the present invention, each indexing reliefs formed in the other cylindrical surface of the rocker shaft extends about at least a portion of the periphery of the outer cylindrical surface. The indexing reliefs extend for a distance sufficient to accommodate a rotational arc traversed by each of the rocker arms as rocker arms actuate the poppet valves. The telescoping pins and indexing reliefs cooperate to prevent the rocker arms from moving axially upon the rocker shaft.

According to another aspect of the present invention, a method for utilizing an internal combustion engine poppet valve rocker arm upon a rocker shaft includes the steps of axially engaging a circular bore formed in a rocker arm body with an end portion of a rocker shaft, so as to drive a resiliently biased telescoping pin, having a normal position projecting from the wall of the bore, into a retracted position in which the pin abuts an outer cylindrical surface of the rocker shaft. The rocker arm body is moved along the rocker shaft until a predetermined valve actuation location has been reached and then, the rocker arm body is rotated to allow the resiliently biased pin to extend from the circular bore into an indexing relief formed in the outer cylindrical surface of the rocker shaft. Thereafter, the rocker arm may be removed from the rocker shaft by rotating the rocker arm body with respect to the rocker shaft sufficiently to slidingly engage telescoping pin with a ramp leading from a lower portion of the indexing relief to the outer cylindrical surface of the rocker shaft, thereby compressing the telescoping pin into its retracted position. Then, the rocker arm body including the retractive telescoping pin may be moved along the rocker shaft until it slides free of the rocker shaft.

It is an advantage of a poppet valve operating system according to the present invention that rocker arms are retained upon a rocker shaft without the need for any additional fasteners, spacers or springs. This helps to prevent improper or incorrect installation of rocker arms in an engine.

It is a further advantage of a valve operating system according to the present invention that excess weight is minimized because of the ability to eliminate additional fasteners, spacers and springs.

It is yet another advantage of a valve operating system according to the present invention that rocker arms may be easily removed or installed from a rocker shaft, so as to permit repair of various components in the valve operating system.

Other advantages, as well as features and objects of the present invention will become apparent to the reader of this specification.

DETAILED DESCRIPTION OF THE PREFERRED EMBODIMENTS

Figure 1:
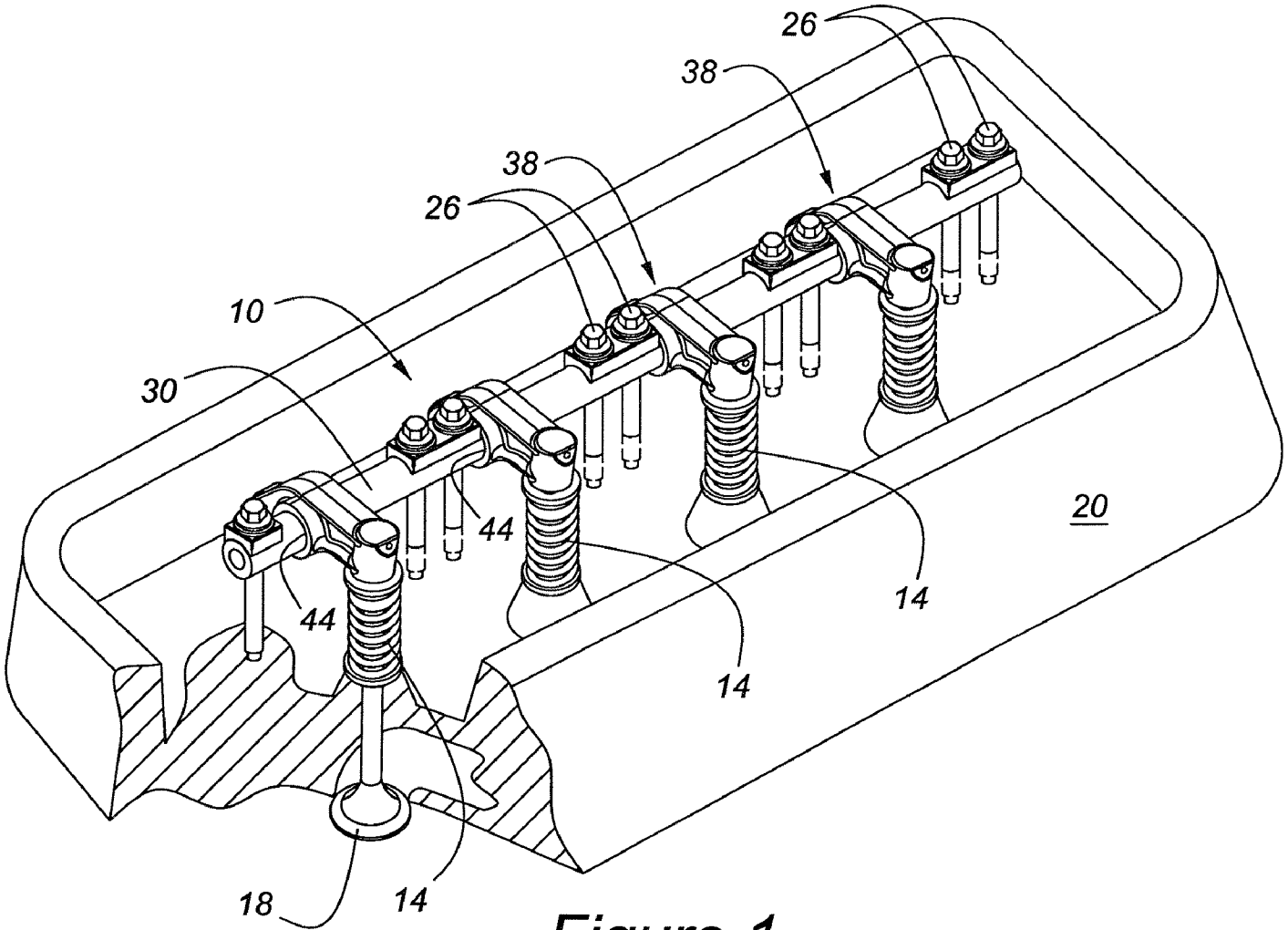
FIG. 1 is a perspective view of a rocker shaft, cylinder head and valves of an engine according to the present invention.
Figure 2:
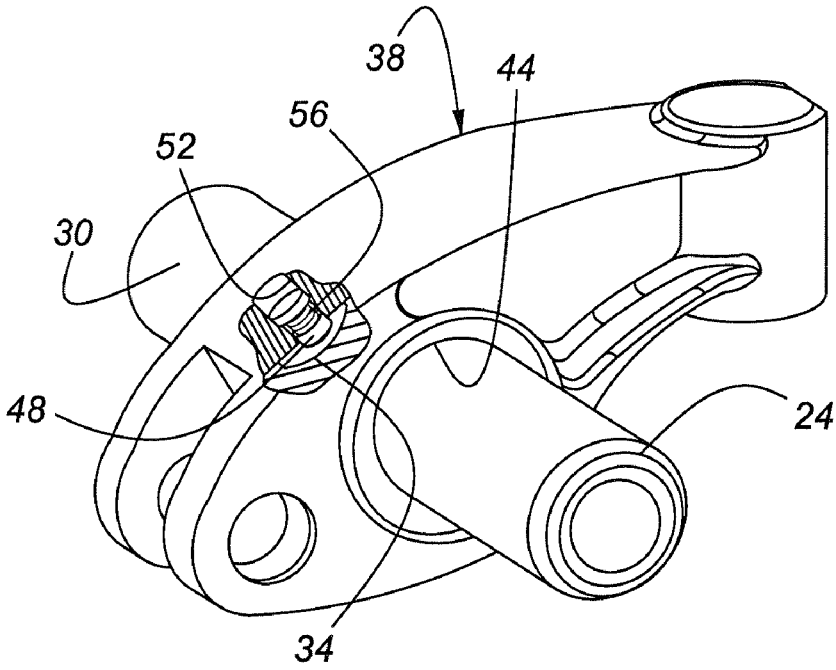
FIG. 2 is a perspective view of a rocker arm according to the present invention installed on a rocker shaft also according to the present invention.

As shown in FIG. 1, poppet valve operating system 10 includes a plurality of poppet valves 14, which are closed by compression springs 18. The poppet valves and springs as well as the valve operating system are mounted upon a cylinder head 20. Rocker shaft 22 is retained to cylinder head 20 by means of a number of cap screws 26. Rocker shaft 22, as shown in FIG. 2, has a chamfered end 24, which assists in installation of a number of rocker arms 38. As shown in FIG. 1, rocker arms 38 are spaced along rocker shaft 22. Each rocker arm 38 must be accurately restrained to prevent unwanted axial movement of the rocker arm, which would cause the rocker arm to cease functioning properly with respect to valves 14, as well as with the driving mechanism, which may be either a push rod or a roller in the case of an overhead cam engine.

Moving now to FIG. 2, rocker arm 38 is shown as being mounted upon rocker shaft 22. Rocker shaft 22 has a cylindrical outer surface 30, which mates with circular bore 44 formed in rocker arm body 42. Circular bore 44 allows rocker arm body 42 to pivot smoothly upon rocker shaft 22. FIG. 2 also shows the resiliently biased telescoping pin which is housed in rocker arm body 42. Details of the pin are shown with particularity in FIGS. 3, 4 and 5.

Figure 3:
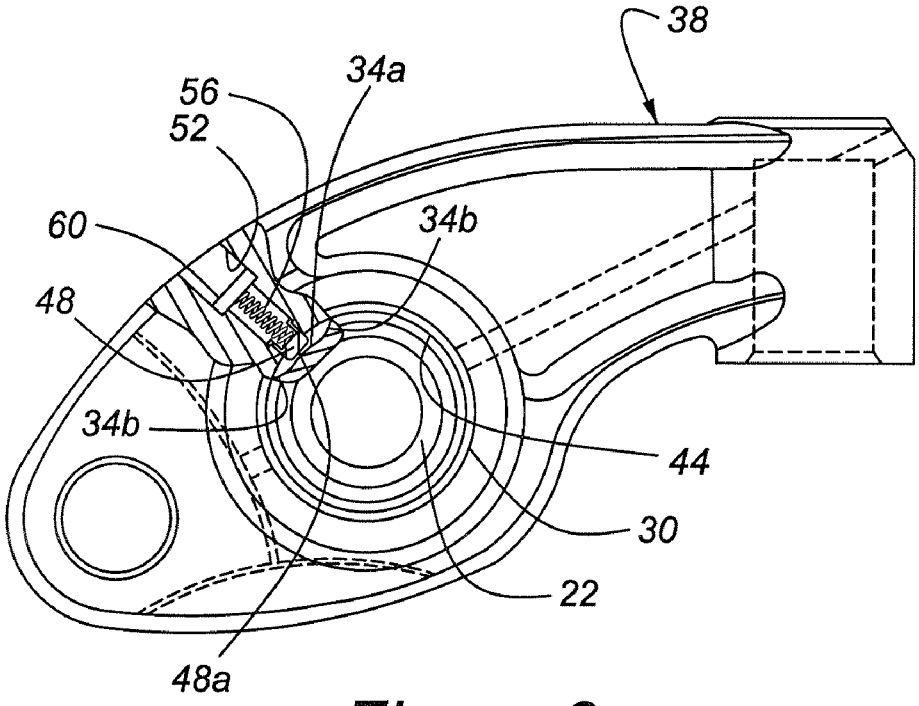
FIG. 3 is sectional view of a rocker arm and rocker shaft according to the present invention.
Figure 4:
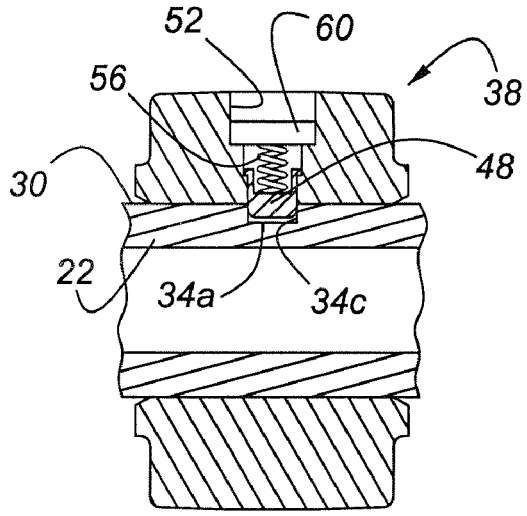
FIG. 4 is a second sectional view taken perpendicular to a rocker shaft according to the present invention.

As seen in FIG. 3, the telescoping pin has a plunger 48 with an inner end 48*a* which projects into circular bore 44 and extends into an indexing relief 34. FIG. 4 shows that indexing relief 34 has a lower portion 34*a* and two side portions 34*c*. Plunger 48 and side portions 34*c* cooperate to prevent rocker arms 38 from moving axially upon rocker shaft 22 during normal operation of an engine having the inventive valve operating system. At the same time, telescoping pin, as embodied by plunger 48, cooperates with indexing reliefs 34 to permit rotational compliance through a predetermined rotational arc. This rotational arc is established with reference to the rotation required by rocker arms 38 to achieve the valve lift designed into a particular engine. In general, the valve lift equals the lift provided by the camshaft, multiplied by the rocker arm ratio.

Figure 5:
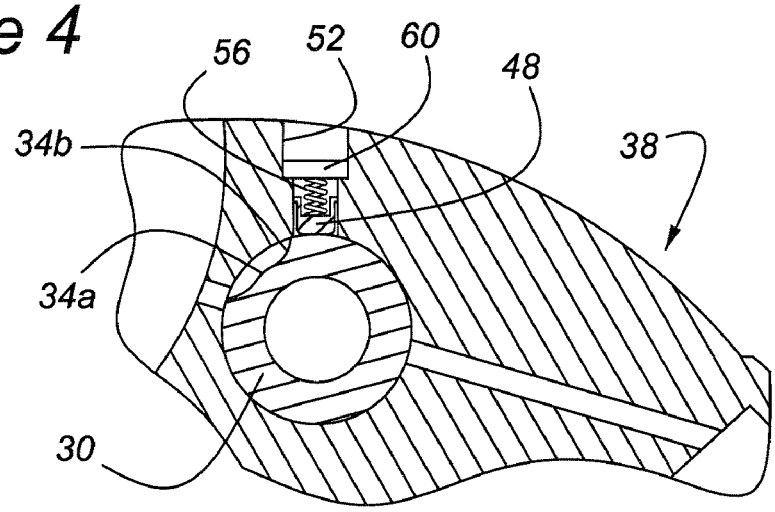
FIG. 5 is a side elevation, partially broken away, of a rocker arm being installed on a rocker shaft according to the present invention.
Figure 6:
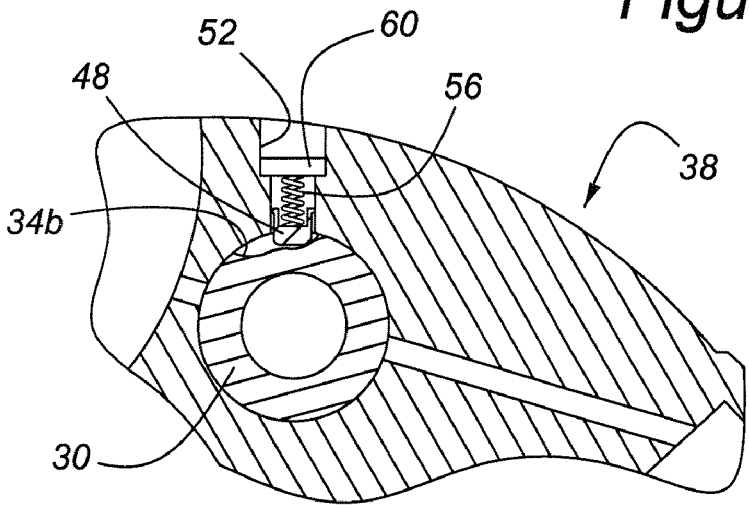
FIG. 6 shows a rocker arm in a axially displaceable mode on a rocker shaft according to the present invention.

FIGS. 5 and 6 show installation features of the present rocker arm and rocker shaft system. As shown in FIG. 5, rocker arm may be slid along rocker shaft 22 by merely rotating rocker arm 38 until plunger 48 is riding upon cylindrical outer surface 30 of rocker shaft 22. Then, when the desired one of indexing reliefs 34 has been reached, rocker arm 38 is merely rotating until plunger 48 extends into indexing relief 34. As long as the rocker arm is rotating in its designed location, plunger 48 will be above surface 34*a* with adequate clearance to prevent contact between plunger 48 and surface 34*a*. If, however, it becomes necessary to remove rocker arm 38 from rocker shaft 22, rocker arm 38 may be rotated until one of the ramp sections 34*b* of indexing relief 34 is contacted, with further rotation serving to compress plunger spring 56 thereby causing plunger 48 to move into its retracted position.

Removal and reinstallation of rocker arms upon a rocker shaft according to the present method permits easy servicing of the valve actuation system, without the need for special tools, because rocker arms 38 need only be rotated upon rocker shafts 22 to allow their disengagement from the rocker shaft and followed by axial movement of the rocker arms off the rocker shaft. This operation is facilitated because the rocker arm body need only be rotated by a small amount exceeding the rotational arc traversed by the rocker arm when the poppet valves are operated.

While particular embodiments of the invention have been shown and described, numerous variations and alternate embodiments will occur to those skilled in the art. Accordingly, it is intended that the invention be limited only in terms of the appended claims.

What is claimed is:

1. A poppet valve operating system for an internal combustion engine, comprising:

a plurality of poppet valves;

a plurality of compression springs for urging said poppet valves into a closed position;

at least one rocker shaft adapted for mounting to a cylinder head of an engine, with said rocker shaft having a cylindrical outer surface;

a plurality of indexing reliefs formed in the outer cylindrical surface of said at least one rocker shaft; and a plurality of rocker arms for actuating said poppet valves, with said rocker arms rotatably mounted to said at least one rocker shaft, and with each of said rocker arms comprising:

a rocker arm body having a circular bore corresponding to the outer cylindrical surface of said at least one rocker shaft; and a resiliently biased, telescoping pin housed in said rocker arm body, with said telescoping pin having an inner end projecting into said circular bore and extending into one of said indexing reliefs, wherein each of said indexing reliefs extends about the periphery of said outer cylindrical surface of said rocker shaft for a distance sufficient to accommodate a rotational arc traversed by each of said rocker arms as the rocker arms actuate said poppet valves.

2. A poppet valve operating system according to claim 1, wherein each of said indexing reliefs has a center section extending below the inner end of said telescoping pin, and at least one ramp section for compressing said telescoping pin in response to rotation of said rocker arm body by an amount exceeding the rotational arc traversed by the rocker arm when said poppet valves are operated.

3. A poppet valve operating system according to claim 1, wherein said resiliently biased, telescoping pin comprises a plunger housed within a radially directed, stepped bore formed in said rocker arm body, with said plunger being biased by a compression spring retained within said stepped bore by a retaining plug.

4. A poppet valve operating system according to claim 1, wherein said resiliently biased, telescoping pins and said indexing reliefs cooperate to prevent said rocker arms from moving axially upon said rocker shaft during normal operation of an engine having said valve operating system.

5. A rocker arm for actuating a poppet valve in an internal combustion engine cylinder head, comprising:

a rocker arm body having a circular bore adapted for rotational engagement with an outer cylindrical surface of a rocker shaft; and a resiliently biased, telescoping pin housed in said rocker arm body, with said telescoping pin having an inner end projecting into said circular bore and adapted to extend into an indexing relief formed in an outer cylindrical surface of a rocker shaft, wherein said telescoping pin cooperates with the indexing relief to retain said rocker arm body in a predetermined axial position upon a rocker shaft, while simultaneously permitting rotational compliance through a predetermined rotational arc.

6. A method for utilizing an internal combustion engine poppet valve rocker arm upon a rocker shaft, comprising:

axially engaging a circular bore, formed in a rocker arm body, with an end portion of a rocker shaft, so as to drive a resiliently biased telescoping pin, having a normal position projecting from the wall of the bore, into a retracted position in which the pin abuts an outer cylindrical surface of the rocker shaft;

moving the rocker arm body along the rocker shaft until a predetermined valve actuation location has been reached; and rotating the rocker arm body to allow the resiliently biased pin to extend from the circular bore into an indexing relief formed in the outer cylindrical surface of the rocker shaft, wherein said indexing relief is configured to axially restrain the rocker arm body from moving away from said predetermined valve actuation location, while simultaneously permitting rotational compliance through a predetermined rotational arc.

7. A method according to claim 6, further comprising removing said rocker arm body from said rocker shaft by:

rotating the rocker arm body with respect to the rocker shaft sufficiently to slidingly engage the telescoping pin with a ramp leading from a lower portion of the indexing relief to the outer cylindrical surface of the rocker shaft, thereby compressing the telescoping pin into its retracted position; and moving the rocker arm body, including the retracted telescoping pin, along the rocker shaft until it slides free of the rocker shaft.

* * * * *